US010569387B2

(12) United States Patent
Philipps et al.

(10) Patent No.: US 10,569,387 B2
(45) Date of Patent: Feb. 25, 2020

(54) POLISHING DISC FOR A TOOL FOR FINE PROCESSING OF OPTICALLY EFFECTIVE SURFACES ON SPECTACLE LENSES

(71) Applicant: Satisloh AG, Baar (CH)

(72) Inventors: Peter Philipps, Dillhausen (DE); Andreas Kaufmann, Hohenahr-Altenkirchen (DE); Steffen Wallendorf, Wetzlar-Dutenhofen (DE); Holger Schäfer, Weilmünster (DE)

(73) Assignee: Satisloh AG, Baar (CH)

( * ) Notice: Subject to any disclaimer, the term of this patent is extended or adjusted under 35 U.S.C. 154(b) by 63 days.

(21) Appl. No.: 15/519,662

(22) PCT Filed: Sep. 16, 2015

(86) PCT No.: PCT/EP2015/001849

§ 371 (c)(1),
(2) Date: Apr. 17, 2017

(87) PCT Pub. No.: WO2016/058661

PCT Pub. Date: Apr. 21, 2016

(65) Prior Publication Data

US 2017/0246729 A1 Aug. 31, 2017

(30) Foreign Application Priority Data

Oct. 15, 2014 (DE) ..... 10 2014 015 052

(51) Int. Cl.
*B24D 13/14* (2006.01)
*B24B 13/01* (2006.01)
(Continued)

(52) U.S. Cl.
CPC ..... *B24D 13/147* (2013.01); *B24B 13/012* (2013.01); *B24B 13/02* (2013.01); *B24D 9/003* (2013.01)

(58) Field of Classification Search
CPC .. B24D 13/147; B24D 18/0045; B24B 13/01; B24B 13/012; B24B 13/02; B24B 37/22
See application file for complete search history.

(56) References Cited

U.S. PATENT DOCUMENTS 2,255,541 A * 9/1941 Dremel ..... B23Q 1/03 144/134.1
2,644,280 A 7/1953 O'Neil, Jr.
(Continued)

FOREIGN PATENT DOCUMENTS

DE 102011014230 A1 * 9/2012 ..... B24B 13/023
JP 2003145402 5/2003

OTHER PUBLICATIONS

Fielder, machine translation of DE 102011014230, Sep. 2012.*
(Continued)

*Primary Examiner* — Timothy V Eley
*Assistant Examiner* — Marcel T Dion
(74) *Attorney, Agent, or Firm* — Reising Ethington P.C.

(57) ABSTRACT

The invention relates to a polishing disc for a tool for fine processing optically active surfaces on spectacle lenses, having a main body which has a central axis and to which an intermediate layer that is softer than the main body and is made of a resilient material is secured, a polishing medium carrier resting on the intermediate layer. The intermediate layer has at least two regions with different degrees of hardness, said regions being arranged one behind the other in the direction of the central axis of the main body. The intermediate layer region adjoining the main part is softer than the intermediate layer region on which the polishing medium carrier rests.

20 Claims, 7 Drawing Sheets

(51) Int. Cl.
*B24B 13/02* (2006.01)
*B24D 9/00* (2006.01)

(56) References Cited

U.S. PATENT DOCUMENTS 3,212,491 A * 10/1965 Balamuth ..... B24B 53/007 125/11.05
7,278,908 B2 10/2007 Urban et al.
7,559,829 B2 7/2009 Stephane et al.
8,246,424 B2 8/2012 Philipps et al.
9,089,948 B2 7/2015 Schäfer et al.
9,289,877 B2 3/2016 Schafer et al.
2002/0182984 A1* 12/2002 Dooley ..... B24B 13/005 451/42
2004/0072522 A1* 4/2004 Petroski ..... B24B 37/22 451/533
2006/0199481 A1* 9/2006 Urban ..... B24B 13/012 451/285
2007/0021036 A1* 1/2007 Kuebler ..... B24B 13/02 451/5
2008/0305723 A1* 12/2008 Philipps ..... B24B 13/02 451/158
2011/0104998 A1* 5/2011 Valencia Merizalde ..... B24B 13/02 451/526
2012/0135672 A1* 5/2012 Schafer; Holger ..... B24B 13/02 451/548
2013/0344778 A1* 12/2013 Schafer ..... B24B 13/023 451/294

OTHER PUBLICATIONS

European Search Report; No. PCT/EP2015/001849 dated Jan. 12, 2016; 12 pages.
German Office Action; Applicant: Satisloh AG; Appln. No. 10 2014 015 052.6; dated Sep. 17, 2015.

* cited by examiner

POLISHING DISC FOR A TOOL FOR FINE PROCESSING OF OPTICALLY EFFECTIVE SURFACES ON SPECTACLE LENSES

TECHNICAL FIELD

The present invention relates to a polishing disc for a tool for fine processing of optically effective surfaces of workpieces, in particular, spectacle lenses according to prescription.

If in the following reference is made to "spectacle lenses" it is to be understood that not only spectacle lenses of mineral glass are meant, but the reference also includes spectacle lenses of all other customary materials such as polycarbonate, CR 39, HI index, and other plastic material.

BACKGROUND OF THE INVENTION

Processing of optically effective surfaces of spectacle lenses by material removal can be roughly divided into two processing phases, namely initially preparatory processing of the optically effective surface for producing the macrogeometry in accordance with prescription and then fine processing of the optically effective surface in order to eliminate preparatory processing tracks and obtain the desired microgeometry true to shape. Whereas preparatory processing of the optically effective surfaces of spectacle lens is carried out in dependence on, inter alia, the material of the spectacle lenses by grinding, milling and/or turning, in fine processing the optically effective surfaces of spectacle lenses are usually subjected to a precision-grinding, lapping and/or polishing process.

For this fine processing procedure use is increasingly made in the prior art (see, for example, documents U.S. Pat. Nos. 7,278,908 and 9,089,948 or 8,246,424) of adaptable polishing discs by contrast to rigid shape-matched tools. These polishing discs have a substantially three-part or triple-layered construction, comprising (1) a carrier body or base body, which faces the tool spindle and is comparatively firm or rigid and to which (2) a layer softer relative thereto of a resilient material, for example a foam material layer, is secured, on which rests (3) a grinding or polishing film (polishing medium carrier), which faces the tool, as the active tool component for processing. As a consequence of the resilient deformability of the foam material layer the polishing film can within certain limits adapt in situ to the geometry of the surface to the processed. This is not only in a "static" respect, i.e. from spectacle lens to spectacle lens which are to be processed and which usually differ in the geometry thereof, particularly the surface curvature, but also in a "dynamic" respect, i.e. during the actual processing of a specific spectacle lens, in which a relative movement between the polishing disc and the spectacle lens takes place. The resilience of the foam material layer additionally influences to a substantial degree the removal behavior of the polishing disc during the polishing process.

Spectacle lenses, which are to be polished, are encountered with the most diverse geometries in production according to prescription. In macrogeometric terms the radii of curvature of the optically effective surfaces (spheres or cylinders in the case of approximately toroidal surfaces) of the spectacle lenses even in the standard effective range (0 to approximately 14 diopters) extend from infinity (planar surface) to approximately 35 mm. In the case of, for example, freeform surfaces there are to be added still further, more microgeometrically influencing factors such as addition or asphericity. In order to cover the standard effective range, geometrically different polishing disc types which differ, in particular, in the (pre-) curvature of the tool surface active for processing are therefore needed in the above prior art.

Thus, known polishing tool concepts in production according to prescription comprise, for example, seven geometrically different polishing disc types. This obviously obliges, during production of spectacle lenses, a tool change if it is necessary to process successive spectacle lenses differing from one another in their geometry in such a way that they cannot be polished by one and the same polishing disc. However, each tool change is at the cost of productivity in production according to prescription.

Polishing tool concepts for spectacle lens production are also known in the prior art which manage with up to at least three different polishing tool types to cover the standard effective range. Such polishing tools are shown in, for example, document U.S. Pat. No. 7,559,829 B2. In that case, inserted between a foam material layer on which a polishing film rests and a rigid base body by way of which the polishing tool can be held in or at a tool mount is a resilient support structure which comprises a star-shaped part with a plurality of spring arms acting in the manner of a leaf spring and a resilient ring for supporting the spring arms relative to the base body. However, a tool change is similarly necessary in this prior art if spectacle lenses to be polished in succession significantly differ from one another in their geometry. In addition, these polishing tools have a relative complex construction.

What is desired as an improvement over the prior art as represented by document U.S. Pat. No. 8,246,424 is a polishing disc, which is of simplest possible construction, for a tool for fine processing of optically effective surfaces at spectacle lenses, which enables increase in productivity in production according to prescription.

SUMMARY OF THE INVENTION

According to one aspect of the invention in a polishing disc for a tool for fine processing of optically effective surfaces at spectacle lenses, the polishing disc has a base body which has a center axis and to which an intermediate layer which is of a resilient material and softer by comparison with the base body is secured. A polishing medium carrier rests on the intermediate layer. The intermediate layer has at least two regions of different hardness arranged one behind the other in the direction of the center axis, wherein the region of the intermediate layer adjoining the base body is softer than the region of the intermediate layer on which the polishing medium carrier rests.

In that regard, the capability of adaptation is provided, which is necessary for coverage of the required effective range (for example 0 to 14 diopters), of the polishing disc to the macrogeometry of the spectacle lenses to be polished by the region, which is remote from processing or engagement, of lesser hardness of the intermediate layer and in that case to bridge over i.e. span over, even large sagittal height differences from spectacle lens to spectacle lens. The capability of adaptation, which is necessary for achieving the required surface trueness on, for example, freeform surfaces and the desired smoothness, of the polishing disc to the microgeometry of the spectacle lenses to be polished is on the other hand provided by the region, which is adjacent to the processing or engagement, of greater hardness of the intermediate layer.

In that regard it is accepted that, during the processing by polishing, the actual polishing surface or engagement area between polishing disc and spectacle lens can change from spectacle lens to spectacle lens in dependence on the respective geometry of the spectacle lens from, for example, almost punctiform in the case of planar spectacle lens surfaces to more (circular or annular) areal in the case of curved spectacle lens surfaces, because in the polishing process compensation for this can be provided by, in particular, suitable change in the amplitude and/or frequency of the relative movement between polishing disc and spectacle lens (oscillation stroke of the tool transversely to the workpiece).

As a result, in the ideal case only one polishing disc type, but in any event significantly fewer polishing disc types than in the prior art forming the category, is or are needed in order to cover the ranges of curvature, which are usual in production according to prescription, of the spectacle lenses to be polished. Such a universally usable polishing disc type on the one hand reduces the outlay connected with the provision of a plurality of geometrically different polishing discs. On the other hand and even more significantly the tool change usual in the prior art and caused by different geometries of the spectacle lenses to be polished can ideally be eliminated, but at least significantly reduced. The thereby-achieved saving of time has the consequence of a substantial increase in productivity, for the same polishing time, in production according to prescription. Standstill times of the polishing machines, including those caused in the prior art by fresh tool adjustment, are at the same time reduced or eliminated. Moreover, according to the invention none of this requires complicated measures or new parts at polishing discs, which are thus of simple construction as previously conceivable; there is merely locally selective influence on the characteristics of the resilient material of the intermediate layer.

With respect to simple and economic production of the polishing discs it is preferred if the at least two regions of the intermediate layer are formed by mutually different foam material layers, namely at least one softer foam material layer on the base body and at least one harder foam material layer under the polishing medium carrier. Other suitable resilient materials for the intermediate layer are, however, equally conceivable, particularly for the harder region of the intermediate layer, which could be made from, for example, a rubber material.

The mutually different foam material layers are preferably glued together, which merely requires an economic process step, which is readily manageable in mass production and in which use can be made of proprietary foam materials and adhesive materials. A suitable foam material composite or foam material sandwich could, however, alternatively also be produced by foaming different categories of foam material one on top of the other.

As far as the shape of the individual foam material layers of the intermediate layer prior to mounting thereof on the base body is concerned, for influencing the resilient characteristics of the polishing disc basically the individual foam bodies can be formed to differ, for example convexly or concavely, from a planar surface at either or both end surfaces, as well as, for example, cylindrically, conically, spherically or annularly-trough-shaped at the edge, for which purpose, however, special casting molds would have to be provided. In that respect, it is preferred particularly for reasons of cost if the different foam material layers of the intermediate layer each have a substantially constant thickness as measured along or parallel to the center axis of the base body, which for the production of the polishing discs offers the possibility of using various materials in plate shape from mass production. Investigations undertaken by the present inventors in that connection have shown that a specific relationship of the thicknesses of the two foam material layers enables optimum adaptation to a large range of radii of curvature with, at the same time, maintenance and smoothing of the microgeometries at the spectacle lenses to be polished. Thus, it was found that the ratio of the substantially constant thickness of the harder foam material layer to the substantially constant thickness of the softer foam material layer should preferably lie between 1 to 2 and 1 to 4, more preferably at approximately 1 to 3.

Practical tests were also undertaken by the inventors with different foam materials, in which it was investigated on the one hand to what extent the geometry of the pre-processed spectacle lens was maintained or changed during polishing and on the other hand the foam materials with which the polishing removal per unit of time was as high as possible without appreciable microstructures or smears occurring on the polished surface. In that connection it was established that, for the case of whole-area compression, the static modulus of elasticity of the harder foam material layer should preferably be between 0.40 and 1.50 $N/mm^2$, more preferably between 0.80 and 1.00 $N/mm^2$, whereas the static modulus of elasticity of the softer foam material layer should preferably lie between 0.25 and 0.45 $N/mm^2$, more preferably between 0.35 and 0.45 $N/mm^2$.

With respect to the foam material of the individual components of the intermediate layer it additionally proved advantageous in the tests that were carried out if the softer foam material layer is made from an at least partly open-pore polyetherurethane elastomer, while the harder foam material layer is made from a closed-cell polyetherurethane elastomer. With this material combination, on the one hand there is no risk of the intermediate layer becoming highly saturated with the polishing medium during polishing and thereafter hardening excessively when dried, but on the other hand the partly open-pore character of the intermediate layer is to be regarded as advantageous for dissipation of the friction heat, which is generated during the polishing process, by way of the polishing medium and in the case of the preferred production of the intermediate layer also assists adhesion of the individual layers.

In addition, in the case of the observations made and investigations undertaken by the inventors the following geometric features for a universally usable polishing disc for processing spectacle lenses by polishing in the currently typical range of curvature were crystallized or proved worthwhile: The base body of the polishing disc should preferably have a substantially spherical end surface which faces the intermediate layer and which is secured, advantageously glued, to the intermediate layer, wherein this end surface should have a radius of curvature which preferably lies between 35 and 42 mm, more preferably between 36 and 40 mm. In addition, the base body should preferably have a diameter in the region of its end surface of between 35 and 60 mm, in which case the substantially constant thickness of the intermediate layer as measured along or parallel to the center axis thereof should preferably be between 15 and 22 mm, advantageously smaller thickness values for the smaller diameters and larger thickness values for the larger diameters.

Moreover, with respect to the polishing medium carrier it is advantageous if this protrudes in radial direction with respect to the center axis of the base body at all sides beyond the intermediate layer of the polishing disc. This protruding region of the polishing medium carrier cannot exert any pressure on the spectacle lens during polishing, so that there is no risk of the outer edge of the polishing medium carrier being imaged on the spectacle lens in the form of microstructures or preferential directions.

The polishing disc according to the invention can advantageously be used at a tool for fine processing of optically effective surfaces at spectacle lenses, the tool comprising a tool mounting head securable to a spindle shaft of a tool spindle to be capable of axial and rotational entrainment, wherein the polishing disc is exchangeably mounted on the tool mounting head, for which purpose the base body of the polishing disc and the tool mounting head are provided with complementary structures for axial detenting and for rotational entrainment of the polishing disc by the tool mounting head. On the one hand this produces an uncomplicated capability of exchange of the polishing disc as well as secure retention of the polishing disc on the tool spindle and on the other hand a defined, mechanically positive torque transmission from the tool spindle to the polishing disc during the processing by polishing.

In that case, the tool mounting head can have a ball joint with a ball head which is received in a ball socket and which is formed at a ball pin securable to the spindle shaft of the tool spindle, whereas the ball socket is formed in a mounting plate with which the polishing disc is detentable. This enables, in simple manner, tilting of the polishing disc relative to the spindle shaft of the tool spindle during processing by polishing, so that the polishing disc can readily follow the most diverse spectacle lens geometries, even, for example, cylindrical surfaces or progressive surfaces with high additions. Moreover, the capability of tilting of the polishing disc advantageously allows performance of polishing processes with what is commonly referred to as "tangential polishing kinematics" in which the polishing disc disposed in processing engagement with the spectacle lens, which is driven by a tool spindle for rotation about a workpiece axis of rotation, either is rotationally entrained by friction or is itself rotationally driven, while a linear drive ensures that the workpiece spindle, which is adjusted in defined manner in angle with respect to the workpiece axis of rotation, in the polishing machine is moved back and forth in alternation so that the polishing disc roams back and forth with a relatively small path to run transversely over the spectacle lens.

In a preferred embodiment, the ball head can have a receiving bore for a transverse pin, which extends through the ball head and engages on either side of the ball head with associated recesses in the ball socket so as to connect the mounting plate with the ball pin to be capable of rotational entrainment. Such a construction of the ball head as a universal joint makes it possible in simple manner to rotationally drive the polishing disc which, by comparison with an equally conceivable, pure frictionally produced rotational entrainment of the polishing disc by the spectacle lens, makes possible substantially shorter polishing times. With respect to tiltability and rotational drive possibility the same could in principle also be realized by means of a homokinetic joint, but this would involve a significantly greater degree of complication and higher costs.

Moreover, it is preferred if the mounting plate is so resiliently supported by way of a resilient annular element at a support flange at the ball-pin side that the polishing disc detented with the mounting plate seeks to self-align by its center axis with the ball pin and thus with the spindle shaft of the tool spindle. In that case, the polishing disc is prevented from excessive tilting movements; on the one hand this has an advantageous effect particularly during the movement reversal in the case of the mentioned oscillation of the polishing disc over the spectacle lens, since the polishing disc cannot bend away and consequently jam at the spectacle lens. On the other hand, such a resilient support of the mounting plate of the tool during mounting or placing of the polishing disc is of advantage because the mounting plate in that case adopts a defined position with slight constraint due to the resilient annular element. Moreover, the movement together of polishing disc and spectacle lens can take place as a consequence of the resilient (pre-) orientation of the mounting plate in such a way that the polishing disc is placed on the spectacle lens substantially in axial orientation and not, for example, tipped, which could lead to problems particularly in the case of thick or elevated polishing discs. In principle, it would also be possible to manage such (pre-) orientation of the polishing disc by means of a pneumatically loadable rubber bellows at the mounting plate, but this would be inordinately more complicated.

In further pursuit of the concept of the invention the base body of the polishing disc and the tool mounting head can each be provided with a radially protruding collar, wherein the collars in the state in which the polishing disc is mounted on the tool mounting head are opposite one another and are engaged over in shape-coupling manner by a securing ring with a substantially U-shaped cross-section. Such a securing ring reliably prevents the polishing disc from unintentionally detaching from the tool mounting head in the case of forces which arise, for example when during the polishing process the polishing disc is lifted off the spectacle lens (or conversely) so as to change the relative tool rotational direction and/or to apply fresh polishing medium to the point of action, or in the case of lifting off at the end of the polishing process, in which case it is always necessary to take into account a polishing disc "sucked onto" the spectacle lens. Accordingly, by virtue of the above securing, the polishing disc and spectacle lens can be moved apart at any time in the polishing process without risk. The problem of unintended detaching of the polishing disc from the tool mounting head can, in fact, also be eliminated in terms of method by a transverse movement of the polishing disc of sufficient width with respect to the spectacle lens prior to lifting off, but this procedure would undesirably lengthen the processing times.

Finally, the securing ring is preferably formed by two half rings which are pivotably connected together on one side by means of a hinge and releasably connected together on the other side by way of a snap connection, which not only represents a simply and economically producible solution—which in addition is readily able to be cleaned—but equally ensures an uncomplicated (because without tool), easy and rapid handling.

BRIEF DESCRIPTION OF THE DRAWINGS

The invention is explained in more detail in the following on the basis of a preferred embodiment with reference to the accompanying partly schematic drawings, which are not true to scale and in which.

DETAILED DESCRIPTION OF THE EMBODIMENT

Figure 1:
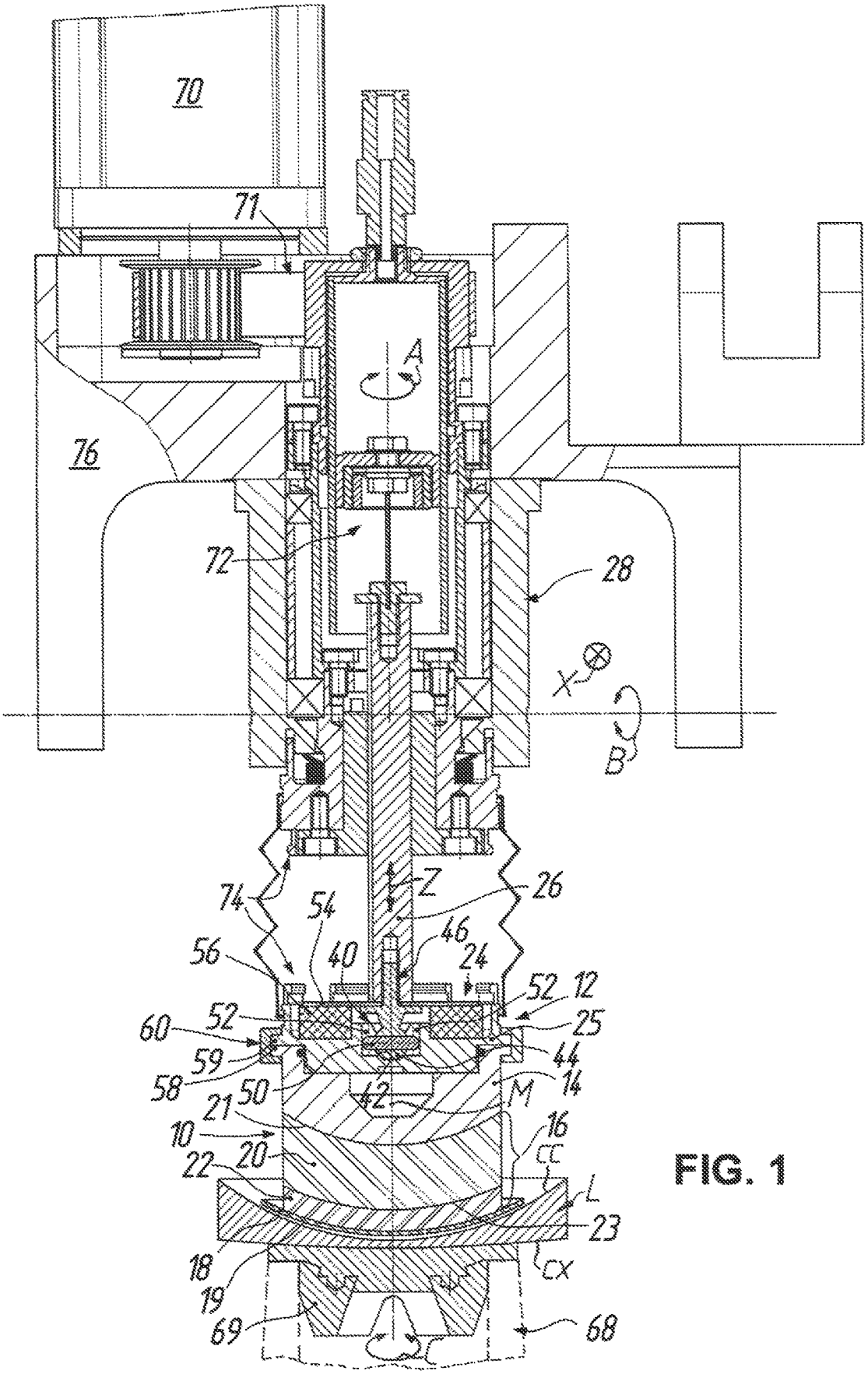
FIG. 1 shows a longitudinal sectional view of a tool spindle, which is mounted in a pivot yoke—illustrated partly broken-away—of a polishing machine, with a tool according to the invention for fine processing of optically effective surfaces at spectacle lenses, on the tool mounting head of which is detachably mounted a polishing disc disposed in processing engagement with a surface to be processed, wherein the tool is in a lower setting moved out relative to the tool spindle.

According to, in particular, FIGS. 1 to 6 a polishing disc 10 for a tool 12 for fine processing of optically effective surfaces cc, cx at spectacle lenses L (cf. FIGS. 1 and 7) comprises a base body 14, which has a center axis M and on which is secured an intermediate layer 16 of a resilient material, the layer being softer by comparison with the base body 14, on which layer a polishing medium carrier 18 forming the actual, outer processing surface 19 of the polishing disc 10 rests. It is significant that the intermediate layer 16 has at least two regions of different hardness, which are arranged in succession in the direction of the center axis M, wherein the region of the intermediate layer 16 adjoining the base body 14 is softer than the region of the intermediate layer 16 on which the polishing medium carrier 18 rests, as will be explained in more detail in the following.

In the embodiment illustrated here, the two regions of the intermediate layer 16 are formed by mutually different foam material layers 20, 22 each of constant thickness as seen along the center axis M, namely a softer foam material layer 20 on the base body 14, more precisely the end surface 21 thereof, and a harder foam material layer 22 under the polishing medium carrier 18. In that case, the mutually different foam material layers 20 and 22 are adhered together at 23.

Equally, the polishing medium carrier 18 is adhered to the harder foam material layer 22 and the softer foam material layer 20 is adhered to the end surface 21 of the base body 14. In order to prevent the edge of the polishing disc 10 from being imaged on the processed surface cc of the spectacle lens L in the form of very fine scratch-like microstructures the polishing medium carrier 18 protrudes at all sides beyond the intermediate layer 16 in radial direction with respect to the center axis M.

The substantially rigid base body 14 on the one hand serves by its preshaped end surface 21 for shaping as well as supporting or bearing the afore-described resilient layer construction of the polishing disc 10 and on the other hand forms the connecting member for the rest of the tool 12, as will still be described in the following. In the illustrated embodiment the end surface 21 of the base body 14 is preshaped to be substantially spherical and quasi arches towards the intermediate layer 16. However, the end surface of the base body can also be differently preshaped, for example aspherically, according to the macrogeometry of the surfaces cc or cx to be processed.

As can be seen in FIGS. 1 to 6, the tool 12 has a tool mounting head 24 with a mounting plate 25, which is secured to a spindle shaft 26 of a tool spindle 28 to be capable of axial and rotational entrainment, but at the same time detachable. The polishing disc 10 is exchangeably mounted on the tool mounting head 24, for which purpose the base body 14 of the polishing disc 10 and the tool mounting head 24, more precisely the mounting plate 25 thereof, are provided with complementary structures 29 (see, in particular, FIGS. 5 and 6) for axial detenting and rotational entrainment of the polishing disc 10 by the tool mounting head 24.

The interface, which is formed by the complementary structures 29, between polishing disc 10 and tool mounting head 24 is the subject matter of document U.S. Pat. No. 9,089,948, which was already mentioned in the introduction and to which, at the outset and for avoidance of repetition, is hereby incorporated by reference with respect to the construction and function of the interface. In short, as can be best seen in FIGS. 4 to 6, the base body 14 of the polishing disc 10 has at its inner side an inner space 32 which is bounded by a wall surface 30 and a base surface 31 and is provided for pushing the polishing disc 10 onto and detenting it to a mounting projection 33 of complementary form at the mounting plate 25 of the tool mounting head 24 and which has at its base surface 31 entrainer elements 34—which are associated with corresponding entrainer mating elements 35 at the mounting projection 33—for torque transmission. In addition, a resilient mounting ring 37 fixed in an annular groove 36 is provided between the wall surface 30 and the mounting projection 33 and provides detenting with a corresponding mating groove 38 and sealing of the inner space 32. In that case, the detenting arises during pushing-on of the polishing disc 10 before the entrainer elements 34 come into engagement with the entrainer mating elements 35, this being achievable only in the case of further pushing-on of the polishing disc 10 with formation of a seal between the wall surface 30 and the mounting projection 33.

On the side of the mounting plate 25 remote from the inner space 32 the tool mounting head 24 has a ball joint 40 with a ball head 44, which is received in a ball socket 42 and which is formed at a ball pin 46 securable to, more precisely able to be screwed into, the spindle shaft 26 of the tool spindle 28. On the other hand, the ball socket 42 is formed in the mounting plate 25 with which the polishing disc 10 is detentable. According to, in particular, FIGS. 3 and 4 the ball head 44 has a receiving bore 48 for a transverse pin 50. The transverse pin 50 extends through the ball head 44 by radiused ends and engages on either side of the ball head 44 in associated recesses 52 in the ball socket 42 so as to connect the mounting plate 35 with the ball pin 46, and thus with the spindle shaft 26 of the tool spindle 28, to be capable of rotational entrainment.

Figure 3:
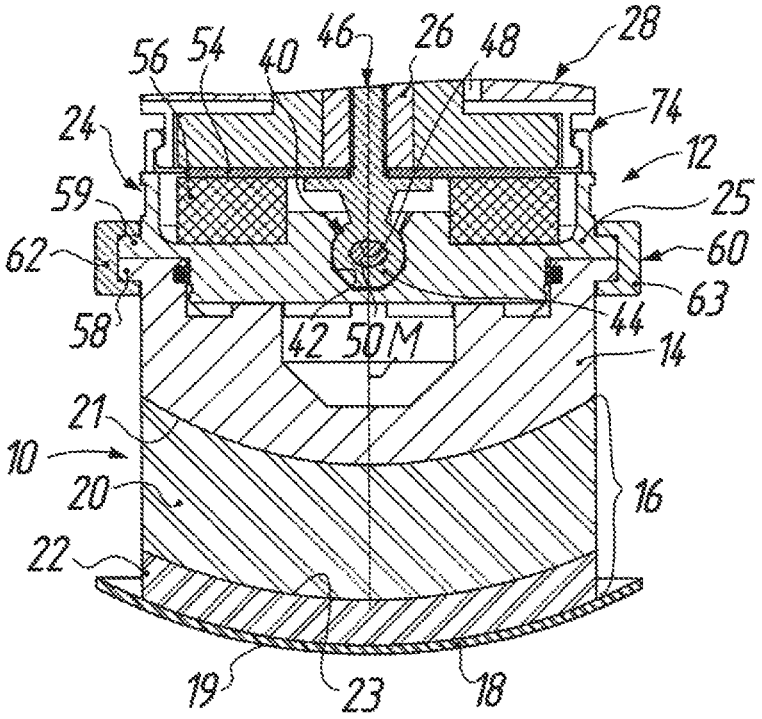
FIG. 3 shows a sectional view, which is broken away at the top, of the tool—which is mounted on the tool spindle—of FIG. 1 in correspondence with the section line III-III in FIG. 2.
Figure 4:
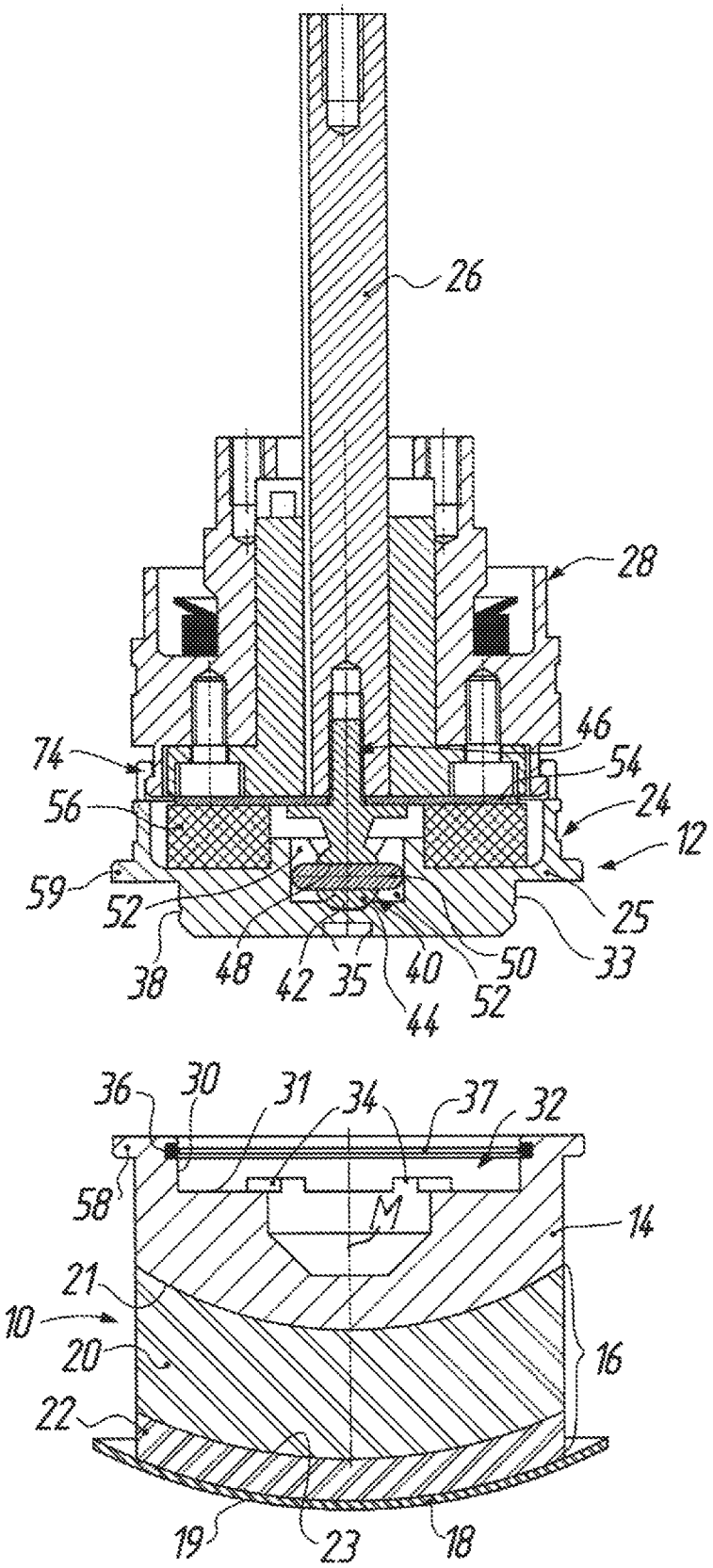
FIG. 4 shows a sectional view of the tool, which is mounted on the tool spindle (here shown only partly), of FIG. 1 in the retracted upper setting according to FIG. 2, with the tool mounting head detented on the tool spindle and a polishing disc removed therefrom.

Moreover, as can be best seen in FIGS. 3 and 4, a circularly annular support flange 54 is inserted between the ball pin 46 and the free end of the spindle shaft 26 and is secured to the spindle shaft 26 by means of the ball pin 46. Resting on the support flange 54 is a resilient annular element 56 of, for example, a suitable foam material, by way of which the mounting plate 25 of the tool mounting head 24 can be resiliently supported on the support flange 54 at the ball-pin side in such a manner that the polishing disc 10 detented with the mounting plate 24 seeks to self-align by its center axis M with the ball pin 46 and thus the spindle shaft 26 of the tool spindle 28.

Figure 5:
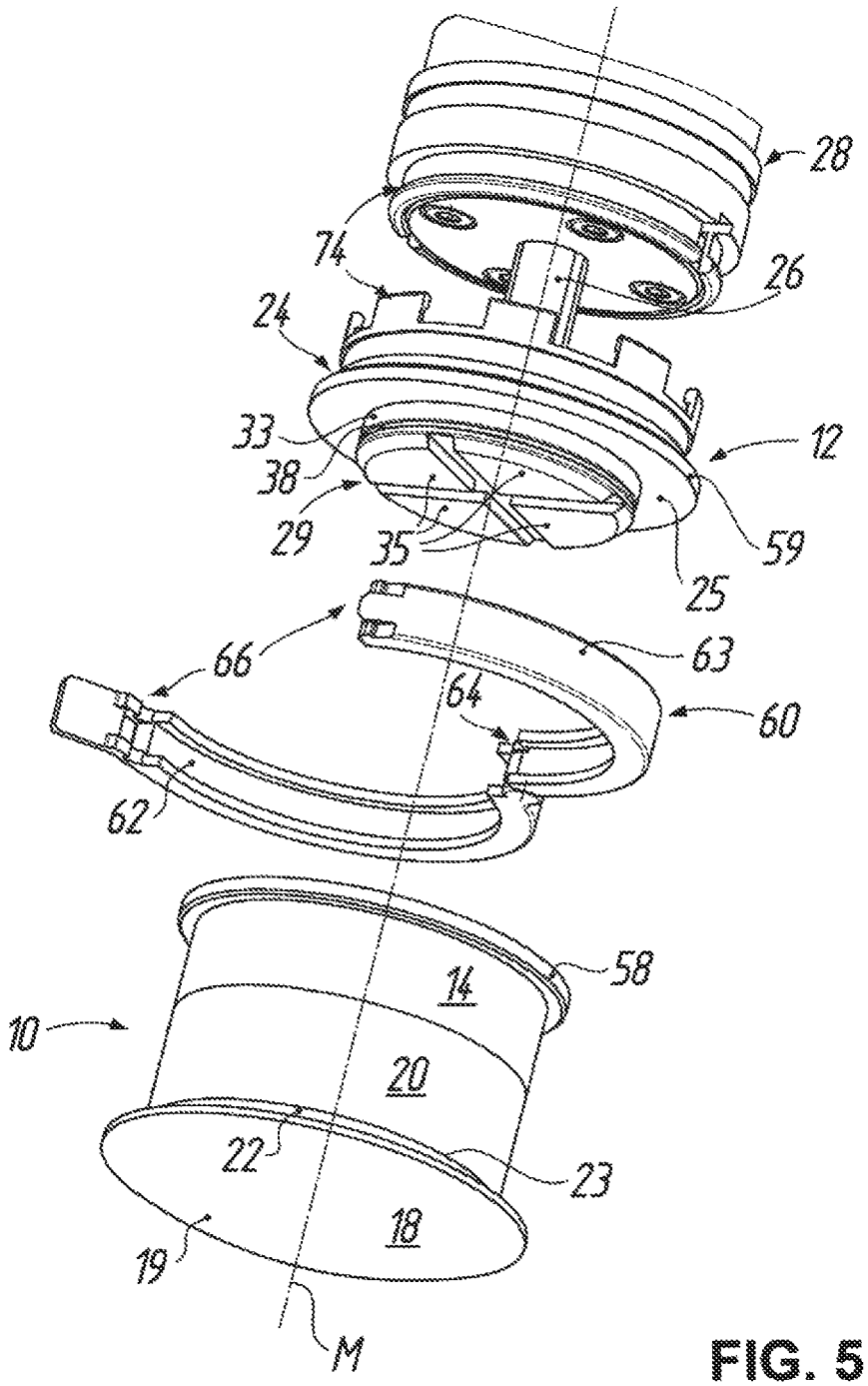
FIG. 5 shows a perspective exploded illustration of the tool, which is moved out relative to the tool spindle (here shown broken away), of FIG. 1 obliquely from below, with the tool mounting head, an opened securing ring and the polishing disc, for illustration of the interfaces between tool spindle, tool mounting head, securing ring and polishing disc.
Figure 6:
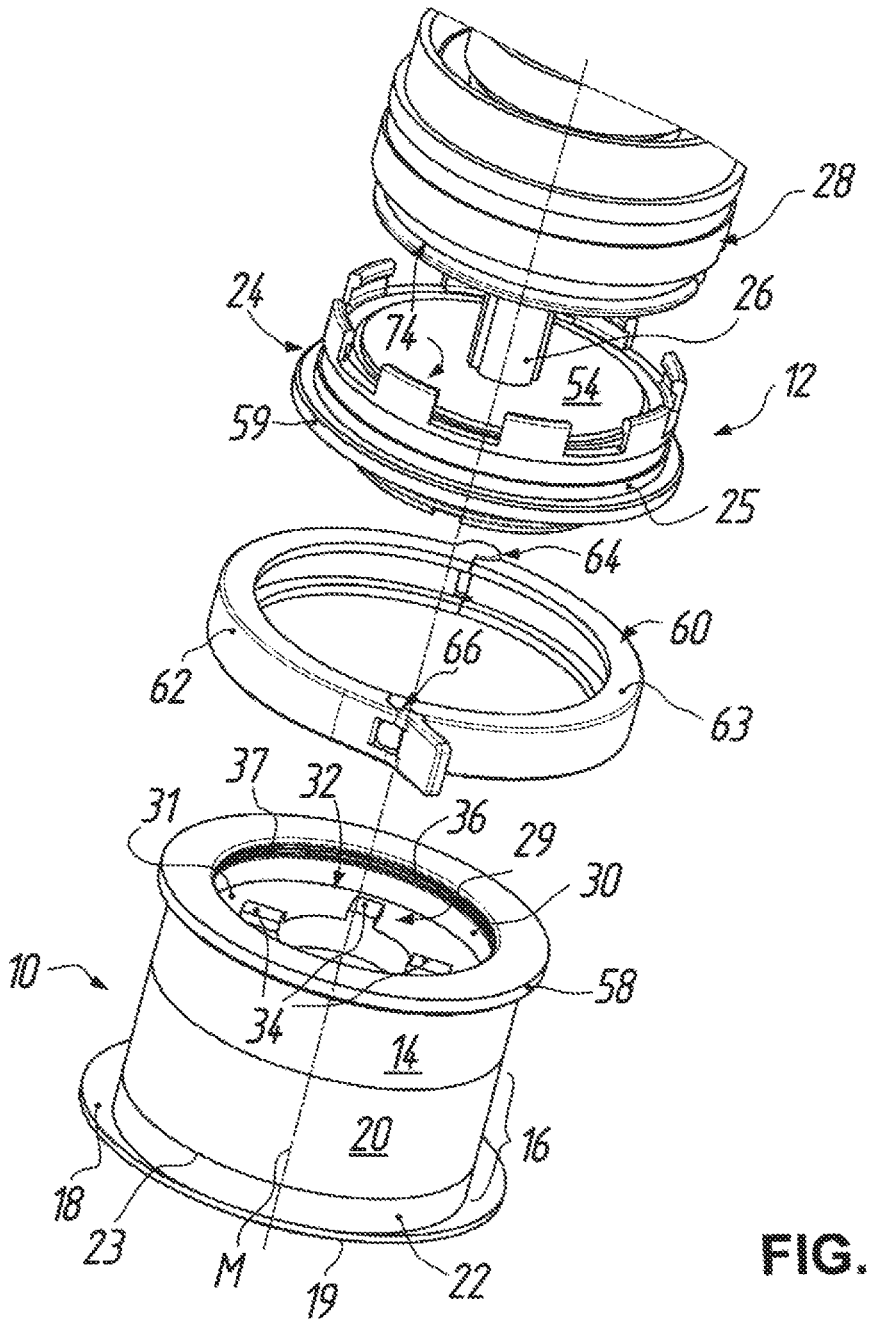
FIG. 6 shows a perspective exploded illustration, which corresponds with respect to the illustrated parts of FIG. 5, of the tool, which is moved out relative to the tool spindle (again shown broken away), of FIG. 1 obliquely from above, with the tool mounting head, the securing ring in closed setting and the polishing disc, for further illustration of the interfaces between tool spindle, tool mounting head, securing ring and polishing disc.

Finally, according to, in particular, FIGS. 3, 5 and 6 each of the base body 14 of the polishing disc 10 and the tool mounting head 24 at the mounting plate 25 is provided with a radially protruding collar 58 or 59 for detachable connection of the polishing disc 10 and tool mounting head 24. In the state in which the polishing disc 10 is mounted on the tool mounting head 24 these collars 58, 59 are opposite one another and are mechanically positively engaged over by a securing ring 60 with a substantially U-shaped cross-section (see FIG. 3) so as to prevent unintended detaching of the polishing disc 10 from the tool mounting head 24. The securing ring 60, which advantageously is made from a suitable plastic material, as can be seen in FIGS. 3, 5 and 6, by two half rings 62, 63 which are pivotably connected together at one side by use of a hinge 64 and at the other side are releasably detentable together by way of a resilient snap connection 66, which is known per se, with undercuts.

Figure 2:
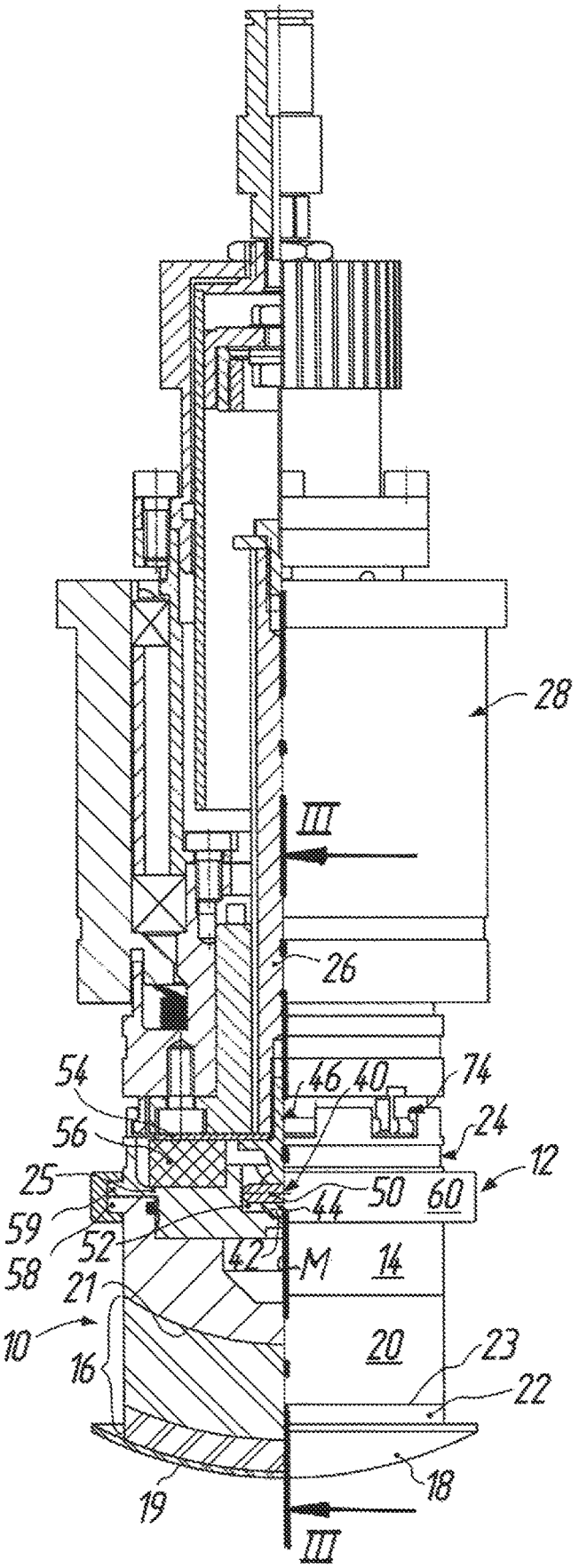
FIG. 2 shows a half section of the tool spindle with tool according to FIG. 1 in the unmounted state and without a bellows between tool and tool spindle, the bellows having been omitted here to allow a better view, wherein the tool together with the polishing disc is disposed in an upper setting retracted relative to the tool spindle, in which the tool mounting head of the tool is detented with the tool spindle.

In order to show the possibilities of movement of the tool 12 relative to the spectacle lens L to be polished, further details of the tool spindle 28 and the installation situation thereof in a polishing device are illustrated in, in particular, FIGS. 1 and 2. This tool spindle 28 as well as the polishing device preferred for use of the tool 12 described here are the subject of parallel German Patent Application DE 10 2014 015 053.4, U.S. Ser. No. filed on the same day as this application, which is hereby incorporated by reference, for the avoidance of repetitions, with regard to the more precise construction and functioning of the tool spindle 28 and the polishing device.

With regard to the possibilities of movement of the spectacle lens L to be processed and of the tool 12 merely the following shall be mentioned here: Arranged opposite the tool spindle 28 in a work space is a workpiece spindle 68 which is indicated in FIG. 1 by dashed lines and by means of which the spectacle lens L to be polished can be driven by way of a block piece, which is mounted in a mount of the workpiece spindle 68, for rotation about a workpiece axis C of rotation. In addition, the spindle shaft 26 of the tool spindle 28 is drivable by an electric servomotor 70 by way of a belt drive 71 for rotation about a tool axis A of rotation. The tool spindle 28 additionally has a pneumatically actuable piston-cylinder arrangement 72, which axially adjusts the tool 12 by way of the spindle shaft 26 along an adjusting axis Z aligned with the tool axis A of rotation. In that case, the tool 12 can, in a setting near the tool spindle, be detented with the tool spindle 28 by way of a detent device 74 (cf. FIGS. 2 to 4).

The tool spindle 28 itself together with servomotor 70 and belt drive 71 is flange-mounted on a pivot yoke 76 pivotable in defined manner about a pivot setting axis B extending substantially perpendicularly to the workpiece axis C of rotation. In addition, the pivot yoke 76 together with tool spindle 28 and the drive thereof can be axially moved along a linear axis X which extends substantially perpendicularly to the plane of the drawing in FIG. 1 and which is oriented substantially perpendicularly not only to the pivot setting axis B, but also to the workpiece rotational axis C.

To that extent, it is evident that the polishing disc 10 and the spectacle lens L can be rotationally driven in the same or opposite sense and at the same or different rotational speeds (rotational axes A, C). At the same time, the polishing disc 10 can be axially adjusted in the direction of the spectacle lens L (setting axis Z). Moreover, the rotational axes A, C can be preset or dynamically pivoted relative to one another in terms of angle (pivot setting axis B) as well as displaced transversely relative to one another (linear axis X). The different polishing processes performable with these kinematics are well-known to one ordinarily skilled in the art and therefore shall not be described in more detail at this point.

Figure 7:
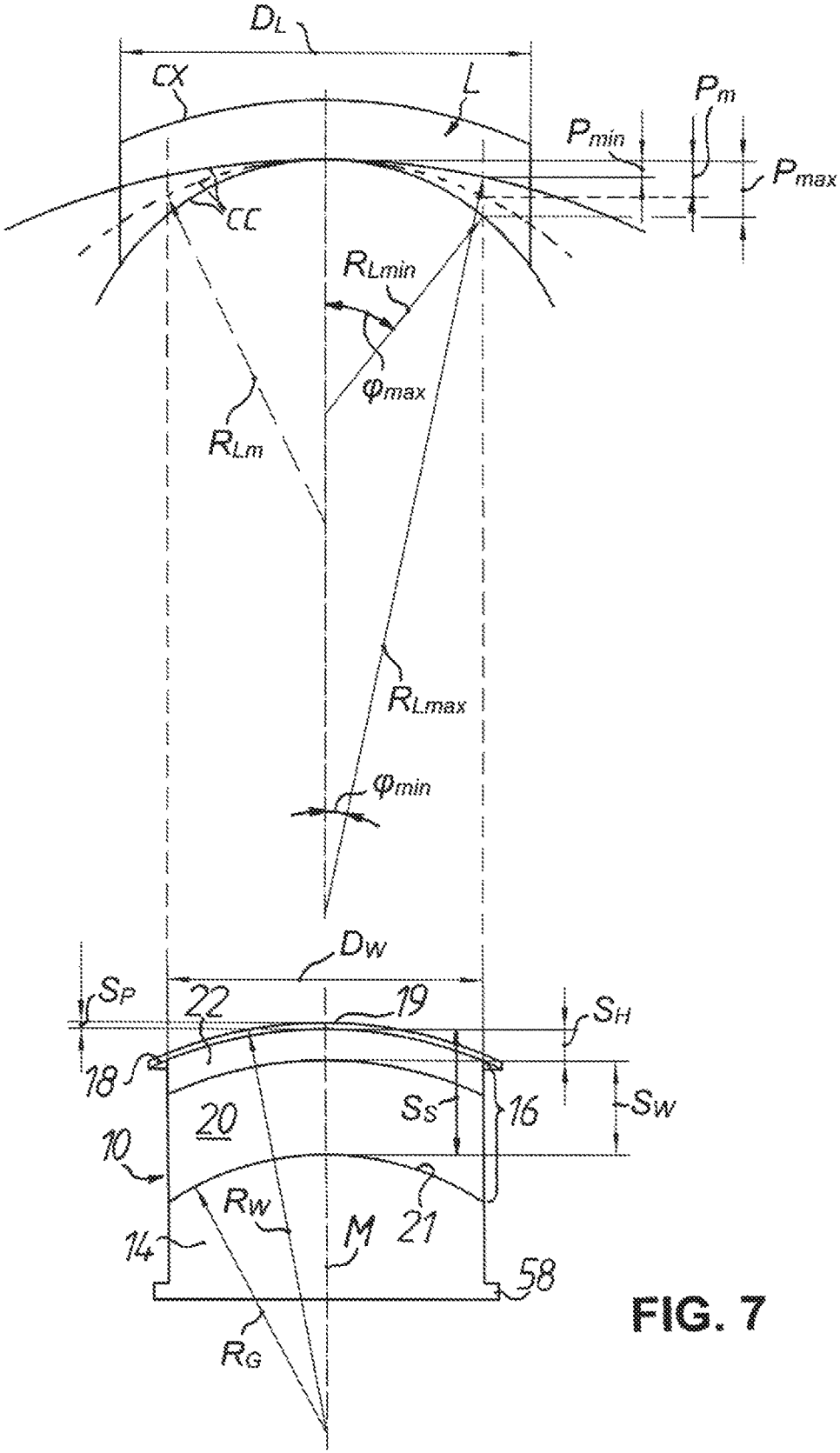
FIG. 7 shows a diagram of a spectacle lens and a polishing disc according to the invention for illustration of the significant geometrical data for the dimensioning of a universally usable polishing disc in dependence on spectacle lens curvatures and spectacle lens diameters.

In the following it shall be explained in more detail with reference to FIG. 7 how the above-described polishing disc 10 can be dimensioned.

In that case, initially there is to be predetermined the range of spectacle lens curvatures involved in polishing of the optically effective surface cc, with $R_{Lmax}$ as the maximum radius of curvature of the flattest spectacle lens L to be processed and $R_{Lmin}$ as the minimum radius of curvature of the most strongly curved spectacle lens L to be processed, as well as the diameter $D_L$ of the spectacle lenses L to be polished.

Based on the experience of the present inventors, the diameter $D_W$ of the polishing disc 10 should be selected to be somewhat smaller than the diameter $D_L$ of the spectacle lens L to be polished, but not too small. Advantageously, the diameter ratio $D_W/D_L$ should lie in the following range:

$$\frac{3}{5} \leq \frac{D_W}{D_L} < 1$$

For example, approximately 50 mm would be a standard diameter $D_W$ for the polishing disc 10. For very small spectacle lens diameters up to 40 mm and for very pronounced spectacle lens curvatures a diameter $D_W$ of the polishing disc 10 of approximately 35 mm would be suitable. On the other hand, for a basically equally possible processing of a spectacle lens at the convex side an even greater diameter $D_W$ of the polishing disc 10 of approximately 60 mm could be provided.

For the thus-selected diameter $D_W$ of the polishing disc 10 it is possible to calculate from the predetermined range of spectacle lens curvatures the (smallest) sagittal height $P_{min}$ of the flattest spectacle lens L and the (largest) sagittal height $P_{max}$ of the most strongly curved spectacle lens L from the following equations:

$$P_{min}=R_{L\,max}\cdot(1-\cos\varphi_{min}) \text{ and } P_{max}=R_{L\,min}\cdot(1-\cos\varphi_{max}),$$

with the (smallest) opening angle $\varphi_{min}$ for the selected diameter $D_W$ of the polishing disc 10 at the flattest spectacle lens L and the (largest) opening angle $\varphi_{max}$ for the selected diameter $D_W$ of the polishing disc 10 at the most strongly curved spectacle lens L calculated from the following formulae:

$$\varphi_{min} = \arcsin\frac{D_W}{2R_{Lmax}} \text{ and } \varphi_{min} = \arcsin\frac{D_W}{2R_{Lmin}}.$$

A mean sagittal height $P_m$ can be determined from the thus-obtained sagittal heights $P_{min}$ and $P_{max}$:

$$P_m = \frac{P_{min} + P_{max}}{2}$$

and from that a mean radius of curvature $R_{Lm}$ of the spectacle lens L with which the radius of curvature $R_W$ of the polishing disc 10 is to correspond at its processing surface 19 at the polishing medium carrier 18:

$$R_{LM} = \frac{P_m^2 + \frac{D_W^2}{4}}{2P_m} = R_W$$

In principle, it would also be possible to additionally undertake weighting of the mean radius of curvature $R_{Lm}$ of the spectacle lens L and thus the radius of curvature $R_W$ of the polishing disc 10 on the basis of statistical frequency of spectacle lens curvatures or to determine the radius of curvature of a universally usable polishing disc solely from a statistical distribution of spectacle lens curvatures, which depends on the respective mode. Thus, currently the maximum of a regionally different statistical distribution is approximately ±5 diopters. If, for example, the current trend to strongly curved sport glasses for prescription lenses continues, a shift towards more bowed curves, i.e. a reduction in the radius of curvature $R_W$ of the polishing disc 10, could be feasible.

Still to be calculated are the total thickness $S_S$ of the intermediate layer 16 and the individual thicknesses of the foam material layers 20, 22, with $S_W$ as the thickness of the softer foam material layer 20 and $S_H$ as the thickness of the harder foam material layer 22 each as seen along or parallel to the center axis M, as well as the radius of curvature $R_G$ of the end surface 21 of the base body 14, wherein the thickness $S_P$ of the proprietary polishing medium carrier 18 is known.

It is assumed for the thickness calculation that the polishing disc 10 during the polishing process has to be a position of bridging over the mean sagittal height $P_M$ under deformation of the intermediate layer 16. Investigations carried out by the inventors have yielded the result that for achieving reproducible polishing results this bridging over should occur in the purely elastic range of deformation of the foam material, in which connection the factor 4 has found to be a satisfactory value, i.e. the maximum deformation of the foam material should not be greater than 25% of the total thickness $S_S$ of the intermediate layer 16, thus:

$$S_S = P_M \cdot 4 = S_H + S_W$$

For determination of the individual thicknesses $S_H$, $S_W$ of the foam material layers 20, 22 the inventors have carried out further tests so as to achieve a satisfactory compromise between capability of adaptation (predominantly macrogeometry) and polishing performance (microgeometry), the following range having been found for the thickness ratio $S_H/S_W$:

$$\frac{1}{2} \geq \frac{S_H}{S_W} \geq \frac{1}{4},$$

with a preferred thickness ratio being approximately 1 ($S_H$) to 3 ($S_W$).

Finally, it is left to calculate the radius of curvature $R_G$ of the end surface 21 of the base body 14 by way of the following simple subtraction:

$$R_G = R_W - S_P - S_S$$

Thus, radii of curvature $R_G$ of the end surface 21 between 35 and 42 mm, with a preferred range between 36 and 40 mm, were found for a typical geometry range, to be polished in spectacle lens production, of up to 14 diopters. In the case of tool diameters $D_W$ of 35 to 60 mm, layer thicknesses $S_S$ between 15 and 22 mm resulted.

In addition, different foam materials were tested in the experiments carried out by the inventors. In that regard, for the hardness or softness of the individual foam materials it has proved that, when determined for the case of whole-area compression (shape factor q=6), the static modulus of elasticity of the softer foam material layer 20 should lie between 0.25 and 0.45 N/mm$^2$, preferably between 0.35 and 0.45 N/mm$^2$, whereas the static modulus of elasticity of the harder foam material layer should be between 0.40 and 1.50 N/mm$^2$, preferably between 0.80 and 1.00 N/mm$^2$.

Moreover, in tests good results—including with regard to service lives—were achieved with foam materials of polyetherurethane elastomers, particularly with at least partly open-pore polyetherurethane elastomer foam material for the softer foam material layer 20, such as is commercially available from, for example, the company Getzner Werkstoffe GmbH, Burs, Austria, under the trade name "Sylomer [Registered Trade Mark] SR28" or "Sylomer [Registered Trade Mark] SR42", and a closed-cell polyetherurethane elastomer foam material for the harder foam material layer 22 such as can be obtained from, for example, the company Getzner under the trade name "Sylodyn [Registered Trade Mark] NC".

The polishing medium carrier 18 forming the tool component active in processing, also termed "polishing film" or "polishing pad", can be a proprietary resilient and abrasion-resistant fine-grinding carrier or polishing-medium carrier such as, for example, a polyurethane (PUR) film having a thickness of 0.5 to 1.4 mm and a hardness of between 12 and 45 according to Shore D. In that regard, the polishing medium carrier 18 is formed to be thicker if preparatory polishing is to be carried out by the polishing disc 10, but thinner in the case of fine polishing. In addition, polishing felts or foam materials treated with heat and pressure can be used with or without carrier material as polishing medium carrier 18, such as available from, for example, the company Delamare, Mantes La Jolie, France. In this connection it may also be mentioned that the upper side, which faces the polishing medium carrier 18, of the harder foam material layer 22 can be provided with a closing mold skin resulting from production technology (separating layer from the mold; not illustrated)—although this is not essential—which gives the intermediate layer 16 at the outside an additional stiffness; in certain circumstances, such a mold skin can even itself form the polishing medium carrier 18.

The base body 14 of the polishing disc 10 is preferably injection-molded from a plastics material such as, for example, an acrylonitrile-butadiene-styrene polymerizate (ABS), for example "Terluran [Registered Trade Mark] GP 35" of the company BASF SE, Ludwigshafen, Germany.

Finally, for example, a proprietary adhesive of the mark "Pattex [Registered Trade Mark]" of the company Henkel AG & Co. KGaA, Du sseldorf, Germany, is suitable for securing together the individual constituents of the polishing disc 10 (base body 14, softer foam material layer 20, harder foam material layer 22, polishing medium carrier 18). However, the polishing medium carrier 18 can, in particular, also be connected in a different way with the intermediate layer 16 with a greater or lesser degree of permanence, for example by vulcanization in place or by hook-and-burr fastening. In every instance, the connection between the individual components of the polishing disc 10 has to be sufficiently firm for mutual movement entrainment, particularly rotational entrainment, to be ensured at all times during processing.

A polishing disc for a tool for fine processing of optically effective surfaces at spectacle lenses comprises a base body, which has a center axis and to which is secured an intermediate layer, which is softer by comparison with the base body and on which a polishing medium carrier rests, of a resilient material. The intermediate layer has at least two regions of different hardness which are arranged in succession in the direction of the center axis of the base body. In that regard, the region of the intermediate layer adjoining the base body is softer than the region of the intermediate layer on which the polishing medium carrier rests. The polishing disc of simple construction can thus cover a large range of spectacle lens curvatures which, in particular, enables a high level of productivity in production according to prescription.

Variations and modifications are possible without departing from the scope and spirit of the present invention as defined by the appended claims.

The invention claimed is:

1. A polishing disc for a tool for fine processing of optically effective curved surfaces on spectacle lenses, comprising a base body which has a center axis and a substantially symmetrical semi-spherical end surface about said center axis and to which is secured an intermediate layer of a resilient material, on which a polishing medium carrier rests, the intermediate layer being softer by comparison with the base body, characterized in that the intermediate layer has at least two regions of different hardness, which are arranged in succession in the direction of the center axis and which are formed by mutually different foam material layers, wherein the foam material layer adjoining the base body is softer than the foam material layer on which the polishing medium carrier rests, each layer having a substantially symmetrical semi-spherical surface about said center axis, and wherein, as determined for the case of whole-area compression, the static modulus of elasticity of the harder foam material layer is between 0.40 and 1.50 N/mm$^2$, whereas the static modulus of elasticity of the softer foam material layer is between 0.25 and 0.45 N/mm$^2$.

2. A polishing disc according to claim 1, characterized in that the mutually different foam material layers are glued together.

3. A polishing disc according to claim 2, characterized in that both the harder foam material layer and the softer foam material layer have substantially constant thicknesses, wherein the ratio of the substantially constant thickness of the harder foam material layer to the substantially constant thickness of the softer foam material layer is between 1 to 2 and 1 to 4, the thicknesses being measured along or parallel to the center axis.

4. A polishing disc according to claim 1, characterized in that the softer foam material layer is made from an at least partly open-pore polyetherurethane elastomer, whereas the harder foam material layer is made from of a closed-cell polyetherurethane elastomer.

5. A polishing disc according to claim 1, characterized in that the intermediate layer is secured, namely firmly glued to the end surface of the base body, wherein the end surface has a radius of curvature of between 35 and 42 mm.

6. A polishing disc according to claim 5, characterized in that the base body has a diameter between 35 and 60 mm in the region of its end surface, wherein the intermediate layer has a substantially constant thickness which is between 15 and 22 mm as measured along or parallel to the center axis.

7. A polishing disc according to claim 6, characterized in that the polishing medium carrier protrudes in radial direction with respect to the center axis at all sides beyond the intermediate layer.

8. A polishing disc according to claim 3, characterized in that the ratio of the substantially constant thickness of the harder foam material layer to the substantially constant thickness of the softer foam material layer is approximately 1 to 3, the thicknesses being measured along or parallel to the center axis.

9. A polishing disc according to claim 1, characterized in that as determined for the case of whole-area compression the static modulus of elasticity of the harder foam material layer is between 0.80 and 1.00 N/mm$^2$, whereas the static modulus of elasticity of the softer foam material layer is between 0.35 and 0.45 N/mm$^2$.

10. A polishing disc according to claim 5, characterized in that the end surface has a radius of curvature of between 36 and 40 mm.

11. A tool for fine processing of optically effective curved surfaces at spectacle lenses, comprising a tool mounting head securable to a spindle shaft of a tool spindle to be capable of axial and rotational entrainment, characterized in that a polishing disc for a tool for fine processing of optically effective curved surfaces on spectacle lenses is exchangeably mounted on the tool mounting head, said polishing disc comprising a base body which has a center axis and a substantially symmetrical semi-spherical end surface about said center axis and to which is secured an intermediate layer of a resilient material, on which a polishing medium carrier rests, the intermediate layer being softer by comparison with the base body, wherein the intermediate layer has at least two regions of different hardness, which are arranged in succession in the direction of the center axis and which are formed by mutually different foam material layers, wherein the foam material layer adjoining the base body is softer than foam material layer on which the polishing medium carrier rests, each layer having a substantially symmetrical semi-spherical end surfact about said center axis, wherein, as determined for the case of whole-area compression, the static modulus of elasticity of the harder foam material layer is between 0.40 and 1.50 N/mm$^2$, whereas the static modulus of elasticity of the softer foam material layer is between 0.25 and 0.45 N/mm$^2$, and wherein for mounting purposes the base body of the polishing disc and the tool mounting head are provided with complementary structures for axial detenting and rotational entrainment of the polishing disc with and by the tool mounting head.

12. A tool according to claim 11, characterized in that the tool mounting head has a ball joint with a ball head which is received in a ball socket and which is formed at a ball pin securable to the spindle shaft of the tool spindle, the ball socket being formed in a mounting plate with which the polishing disc is detentable.

13. A tool according to claim 12, characterized in that the ball head has a receiving bore for a transverse pin which extends through the ball head and engages on either side of the ball head in associated recesses in the ball socket so as to connect the mounting plate with the ball pin to be capable of rotational entrainment.

14. A tool according to claim 13, characterized in that the mounting plate is resiliently supported on a support flange at the ball-pin side by way of a resilient annular element so that the polishing disc detented with the mounting plate seeks to self-align by its center axis with the ball pin and thus the spindle shaft of the tool spindle.

15. A tool according to claim 14, characterized in that the base body of the polishing disc and the tool mounting head are each provided with a respective radially protruding collar, wherein the collars in the state in which the polishing disc is mounted on the tool mounting head are opposite one another and mechanically positively engaged over by a securing ring with a substantially U-shaped cross-section.

16. A tool according to claim 15, characterized in that the securing ring is formed by two half rings which are pivotably connected together on one side by use of a hinge and are releasably detentable together on the other side by way of a snap connection.

17. A tool according to claim 12, characterized in that the mounting plate is resiliently supported on a support flange at the ball-pin side by way of a resilient annular element so that the polishing disc detented with the mounting plate seeks to self-align by its center axis with the ball pin and thus the spindle shaft of the tool spindle.

18. A tool according to claim 11, characterized in that the base body of the polishing disc and the tool mounting head are each provided with a respective radially protruding collar, wherein the collars in the state in which the polishing disc is mounted on the tool mounting head are opposite one another and mechanically positively engaged over by a securing ring with a substantially U-shaped cross-section.

19. A polishing disc for a tool for fine processing of optically effective curved surfaces on spectacle lenses, comprising a base body which has a center axis and a substantially symmetrical semi-spherical end surface about said center axis and to which is secured an intermediate layer of resilient material, on which a polishing medium carrier rests, the intermediate layer being softer by comparison with the base body, characterized in that the intermediate layer has at least two regions of different hardness which are arranged in succession in the direction of the center axis and which are formed by mutually different foam material layers, each region having a substantially symmetrical curved surface about said center axis, wherein the region of the intermediate layer adjoining the base body is softer than the region of the intermediate layer on which the polishing medium carrier rests.

20. A polishing disc according to claim 19, characterized in that the mutually different foam material layers are glued together.

* * * * *